US011624233B2

(12) United States Patent
Zhang

(10) Patent No.: US 11,624,233 B2
(45) Date of Patent: Apr. 11, 2023

(54) SELF-LOCKING BALANCE WEIGHT-TYPE INSULATED GLASS ASSEMBLY HAVING INTERNAL BLINDS

(71) Applicant: Xuezhong Zhang, Dalian (CN)

(72) Inventor: Xuezhong Zhang, Dalian (CN)

( * ) Notice: Subject to any disclaimer, the term of this patent is extended or adjusted under 35 U.S.C. 154(b) by 721 days.

(21) Appl. No.: 16/669,680

(22) Filed: Oct. 31, 2019

(65) Prior Publication Data

US 2021/0131174 A1 May 6, 2021

(51) Int. Cl.

| | |
|---|---|
| ***E06B 9/264*** | (2006.01) |
| ***E06B 3/663*** | (2006.01) |
| ***E06B 9/322*** | (2006.01) |

(52) U.S. Cl.

CPC ..... *E06B 9/264* (2013.01); *E06B 3/663* (2013.01); *E06B 9/322* (2013.01); *E06B 2009/2646* (2013.01)

(58) Field of Classification Search

CPC . E06B 9/264; E06B 9/322; E06B 9/32; E06B 2009/2646; E06B 2009/2643; E06B 2009/3222; E06B 9/303; E06B 9/26; E06B 3/663; E06B 3/6722

See application file for complete search history.

(56) References Cited

U.S. PATENT DOCUMENTS

| | | | | |
|---|---|---|---|---|
| 9,410,364 | B1 * | 8/2016 | Zheng | E06B 9/322 |
| 11,293,219 | B2 * | 4/2022 | Zhang | E06B 9/264 |
| 2007/0017644 | A1 * | 1/2007 | Berger | E06B 3/04 160/107 |
| 2008/0083511 | A1 * | 4/2008 | Hung | E06B 9/32 160/168.1 R |

FOREIGN PATENT DOCUMENTS

| | | | | |
|---|---|---|---|---|
| CN | 108643808 | A * | 10/2018 | E06B 9/264 |
| CN | 111928290 | A * | 11/2020 | F23J 15/003 |
| WO | WO-2015177816 | A1 * | 11/2015 | E06B 9/264 |

* cited by examiner

*Primary Examiner* — Marcus Menezes
*Assistant Examiner* — Jeremy C Ramsey
(74) *Attorney, Agent, or Firm* — Daniel M. Cohn; Howard M. Cohn

(57) ABSTRACT

A self-locking balance weight-type insulated glass assembly has two panes of glass with an inner cavity and a blinds assembly therein. The blinds assembly comprises a head rail, a slat assembly hung on the head rail, a bottom rail, a privacy fascia and a hollow side rail. The head rail has a hollow inner cavity with a rotary rod assembly and a rotary rod locking device therein. The slat assembly, the bottom rail and the rotary rod assembly are connected through a pull cord for controlling slats to rise or fall and a ladder cord for controlling the slats to turn. The rotary rod locking device has an end connected to the rotary rod assembly and an end connected to a gear box. An external magnetic operator is magnetically coupled to an internal magnetic operator arranged outside the inner cavity formed by the panes of glass.

18 Claims, 6 Drawing Sheets

SELF-LOCKING BALANCE WEIGHT-TYPE INSULATED GLASS ASSEMBLY HAVING INTERNAL BLINDS

FIELD OF THE INVENTION

The present invention relates to blinds assemblies, and in particular to a self-locking, balance weight-type insulated glass assembly having internal blinds.

BACKGROUND OF THE INVENTION

Insulated glass assemblies having internal blinds have the advantages of heat insulation and sound insulation of insulated glass as well as the functions of shielding against sunlight and obstructing the view of blinds assemblies, are dust-free, and have the unique advantages of long service life, and the like, thereby being applied more and more widely and becoming larger and larger. In order to ensure the airtightness of products, blinds assemblies are magnetically controlled in most cases. However, magnetic operation and control on large-sized blinds assemblies becomes very difficult due to the large weight of slats and the large friction between the slats and the glass.

A generally effective way to handle this situation is to configure a counter-weight on an internal magnetic operator to reduce the amount of control force required. However, due to the fact that the control force required for lifting the blinds assembly increases gradually while the weight of the counter-weight is constant, only part of the weight of blinds slat is balanced. When the insulated glass assembly is assembled and transported, the unfixed counter-weight can move randomly and destroy parts nearby.

In addition, when the insulated glass assembly having internal blinds is stored or transported, the slats have to be folded to be prevented from being damaged. However, in this case, the bottom rail, the slat assembly and a head rail are first assembled together and then assembled on the side rail to form an instable L-shaped structure which occupies a large space during storage or transportation and is likely to be damaged. The required amount of space can be greatly reduced if the bottom rail, the slat assembly and the head rail are independently stored or transported after assembly, without being assembled on the side rail. However, in this case, the slat assembly may be unfolded and then are bent and deformed.

According to an existing solution, after the bottom rail, the slat assembly and the head rail are assembled, the slats are folded and then bound together to be stored or transported. Then, the slats are unbound when the whole blinds assembly and insulated glass are assembled. However, this solution consumes a lot of time and labor.

BRIEF SUMMARY OF THE INVENTION

The objective of the invention is to overcome the defects of the prior art by providing a self-locking balance weight-type insulated glass assembly having internal blinds. According to the self-locking balance weight-type insulated glass assembly having internal blinds, the weight of blinds slats can be balanced all the time, and the blinds slats can be easily controlled; undesired movement of the blinds slats and a counter weight can be prevented, so that blinds are protected, and storage and transportation are facilitated.

To fulfill the above objective, the self-locking balance weight-type insulated glass assembly having internal blinds comprises a piece of insulated glass comprising two pieces of glass and a spacer frame, and a blinds assembly, wherein the blinds assembly is arranged in an inner cavity of the insulated glass; the blinds assembly comprises a head rail attached to the top of the spacer frame, a slat assembly hung on the head rail, a bottom rail, and a privacy fascia and a side rail which are attached to two sides of the spacer frame, the head rail is hollow, and a rotary rod assembly and a rotary rod locking device are arranged in an inner cavity of the head rail; the slat assembly, the bottom rail and the rotary rod assembly are connected through a pull cord used for controlling slats to rise or fall and a ladder cord used for controlling the slats to turn; the rotary rod locking device has an end connected to the rotary rod assembly and an end connected to a gear box; the side rail is hollow, the gear box is arranged at the top of an inner cavity of the side rail, and an internal magnetic operator, a belt tensioning wheel and a belt are arranged under the gear box; and an external magnetic operator magnetically coupled to the internal magnetic operator is arranged outside the insulated glass.

The self-locking balance weight-type insulated glass assembly having internal blinds further comprises a counter-weight self-locking device connected to the gear box through a counter-weight line, and a counter-weight fixed below the counter weight self-locking device.

According to the self-locking balance weight-type insulated glass assembly having internal blinds, the gear box comprises a cone wheel shaft, a belt wheel, a screw rod and a counter weight line guide; two ends of the belt are connected to an upper end and a lower end of the internal magnetic operator to form a closed loop and are wound on the belt wheel and the belt tensioning wheel; the cone wheel shaft, the belt wheel and the screw rod are connected in an engaged manner through a gear set; the cone wheel shaft has an end provided with an internal gear and an end provided with a cone wheel, a large-diameter end of the cone wheel is connected to one end of the counter weight line, and the counter weight line has an end penetrating through the counter weight line guide to be connected to the counter weight self-locking device; and when the slat assembly in a fully folded state descends to be completely unfolded, the counter weight line is horizontally pushed by the counter weight line guide to be wound from the large-diameter end of the cone wheel to a small-diameter end of the cone wheel, a torque applied by the gravity of the counter weight to the cone wheel shaft via the counter weight line is decreased from the maximum to the minimum and is always kept in balance with a torque which is applied by the slat assembly to the rotary rod assembly and transmitted to the cone wheel shaft via the rotary rod locking device, and vice versa.

According to the self-locking balance weight-type insulated glass assembly having internal blinds, a threaded groove is formed in a cone face of the cone wheel, and the counter weight line falls into the threaded groove when wound on the cone wheel; and the counter weight line guide is internally provided with an internal thread and is matched with the screw rod, and when the screw rod rotates, the counter weight line guide horizontally moves leftwards or rightwards to push the counter weight line to a corresponding position of the cone wheel.

According to the self-locking balance weight-type insulated glass assembly having internal blinds, the counter weight self-locking device is mounted in the side rail, the counter weight is arranged below the counter weight self-locking device, and the counter weight self-locking device and the counter weight are slightly thinner and narrower than the inner-diameter of the cavity of the side rail; and the counter weight self-locking device comprises: a base, wherein the base has a bottom fixed to the counter-weight and is provided with a base limit stop; a set of elastic pieces, wherein each elastic piece has an end fixed to the base, and a free end; the elastic pieces have an angle relative to one vertical edge of the base, and the free ends of the elastic pieces obliquely stretch upwards to be slightly beyond the vertical edge of the base; the distance between the free ends of the elastic pieces and the other vertical edge of the base is slightly greater than an inner diameter of the side rail in a corresponding direction; and a cover plate, wherein the cover plate is provided with a set of elastic piece ejector blocks located below the free ends of the elastic pieces and is further provided with a cover plate limit stop located below the base limit stop; the cover plate is connected to the other end of the counter weight line and is able to move upwards or downwards between the base limit stop and the counter weight; when the self-locking balance weight-type insulated glass assembly having internal blinds is vertically placed, the counter weight pull the base downwards by gravity, the cover plate is pulled by the counter weight line to move upwards relative to the base until the cover plate limit stop touches the base limit stop, at this moment, the elastic piece ejector blocks located below the free ends of the elastic pieces eject the free ends of the elastic pieces to force the elastic pieces to bend, and then the free ends of the elastic pieces retreat into the vertical edges of the base, so that the elastic pieces fail to touch the side rail, and the counter weight self-locking device and the counter weight are pulled by the counter weight line to move upwards or downwards freely; and when the self-locking balance weight-type insulated glass assembly having internal blinds is horizontally placed, the counter weight is supported by the side rail and cannot pull the base to move, in this case, the free ends of the elastic pieces stretch out of the vertical edges of the base to be in close contact with the inner wall of the side rail and are self-locked in a direction from the counter weight to the counter weight self-locking device, and the counter weight cannot move in this direction or in the opposite direction either under the traction from the counter weight line.

According to the self-locking balance weight-type insulated glass assembly having internal blinds, long grooves which are wider than the belt are formed in the counter weight and the counter weight self-locking device, and the belt penetrates through the long grooves to be connected to the belt wheel in the gear box, the belt tensioning wheel, and the internal magnetic operator.

According to the self-locking balance weight-type insulated glass assembly having internal blinds, the rotary rod locking device comprises a stationary base, a gear shaft, a locking ring and a spring, wherein the stationary base is fixed in the head rail and is located at one end of the rotary rod assembly; the middle of the gear shaft is fixed to the stationary base through a bearing, one of two ends of the gear shaft is fixed to the rotary rod assembly, and the other end of the two ends of the gear shaft is provided with an external gear which stretches out of the stationary base; a cavity is formed in the stationary base, and the locking ring is in clearance fit with the cavity and is internally provided with an internal gear matched with the external gear at one end of the gear shaft; the spring is arranged between the locking ring and the stationary base; when locking ring is pushed into the stationary base by the internal gear located on the cone wheel shaft of the gear box, the internal gear on the cone wheel shaft is engaged with the external gear on the gear shaft, and at this moment, the rotary rod assembly is controlled by the gear box; and when to be separated from the internal gear located on the cone wheel shaft, the locking ring is partially pushed out by the spring to be partially matched with the cavity of the stationary base, the internal gear of the locking ring is partially engaged with the external gear on the gear shaft, and the gear shaft and the rotary rod assembly are locked by the locking ring to be prevented from rotating.

When the self-locking balance weight-type insulated glass assembly having internal blinds is vertically placed, the counter weight pulls the base downwards by gravity until the base limit stop touches the cover plate limit stop, at this moment, the elastic piece ejector blocks located below the free ends of the elastic pieces eject the free ends of the elastic pieces to force the elastic pieces to bend, and then the free ends of the elastic pieces retreat into the vertical edges of the base, so that the elastic pieces fail to touch the side rail, the counter weight and the counter weight self-locking device are pulled by the counter weight line to freely move upwards or downwards in the side rail, and the gravity of the counter weight is transmitted by the counter weight self-locking device to the counter weight line to enable the counter weight line to generate a pulling force. When the external magnetic operator is moved downwards, the internal magnetic operator magnetically coupled to the external magnetic operator drives the belt, connected to the internal magnetic operator, to move downwards accordingly, so as to drive the belt wheel, the screw rod, the cone wheel shaft, the gear shaft engaged with the cone wheel shaft, and the rotary rod assembly fixed to the gear shaft to rotate synchronously, the slat assembly is pulled to rise continuously, and a torque applied by the slat assembly to the rotary rod assembly is gradually increased; at the same time, the screw rod rotates to push the counter weight line guide and the counter weight line to move towards the large-diameter end of the cone wheel, the counter weight line is gradually unwound from the cone wheel, the arm of the pulling force of the counter weight line becomes larger and larger, and a reverse torque applied by the pulling force to the cone wheel becomes larger and larger accordingly and is transmitted by the gear shaft of the rotary rod locking device to the rotary rod assembly and is always kept in balance with the torque applied by the slat assembly to the rotary rod assembly, so that the slat assembly can be easily controlled to rise or fall and to turn with a small force. In most cases, the self-locking balance weight-type insulated glass assembly having internal blinds is horizontally placed when transported; in these cases, the side rail is horizontal, the counter weight fails to apply a pulling force to the base of the counter weight self-locking device by gravity, the elastic pieces in the base are not ejected by the elastic piece ejector blocks on the cover plate, the elastic pieces are kept straight with the free ends stretching out of the vertical edges of the base to be in close contact with the inner surface of the side rail so as to realize self-locking, and the counter weight cannot move towards the counter weight self-locking device; and under effect of the pulling force from the counter weight line, the counter weight cannot move in the opposite direction either, and thus, impact damage to other parts caused by movement of the counter weight is avoided. Moreover, in the case where the head rail is not assembled on the side rail yet, the stationary base is fixed into the head rail, the gear box in the side rail is not connected to the rotary rod locking device, the locking ring cannot rotate after being pushed by the spring out of the stationary base by a certain distance due to the fact that part of the locking ring is still left in the stationary base, and the internal gear of the locking ring is partially engaged with the external gear on the gear shaft, so that the gear shaft is locked and cannot rotate freely, and the rotary rod assembly fixed to the gear shaft cannot freely rotate either. In this way, the folded slat assembly will not be unfolded; and the bottom rail, the slat assembly and the head rail can be stored and transported independently of the side rail after being assembled, so that the space is saved, and slats are protected.

BRIEF DESCRIPTION OF THE SEVERAL VIEWS OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader and should not in any way be interpreted as limiting.

DETAILED DESCRIPTION OF THE INVENTION

Figure 1:
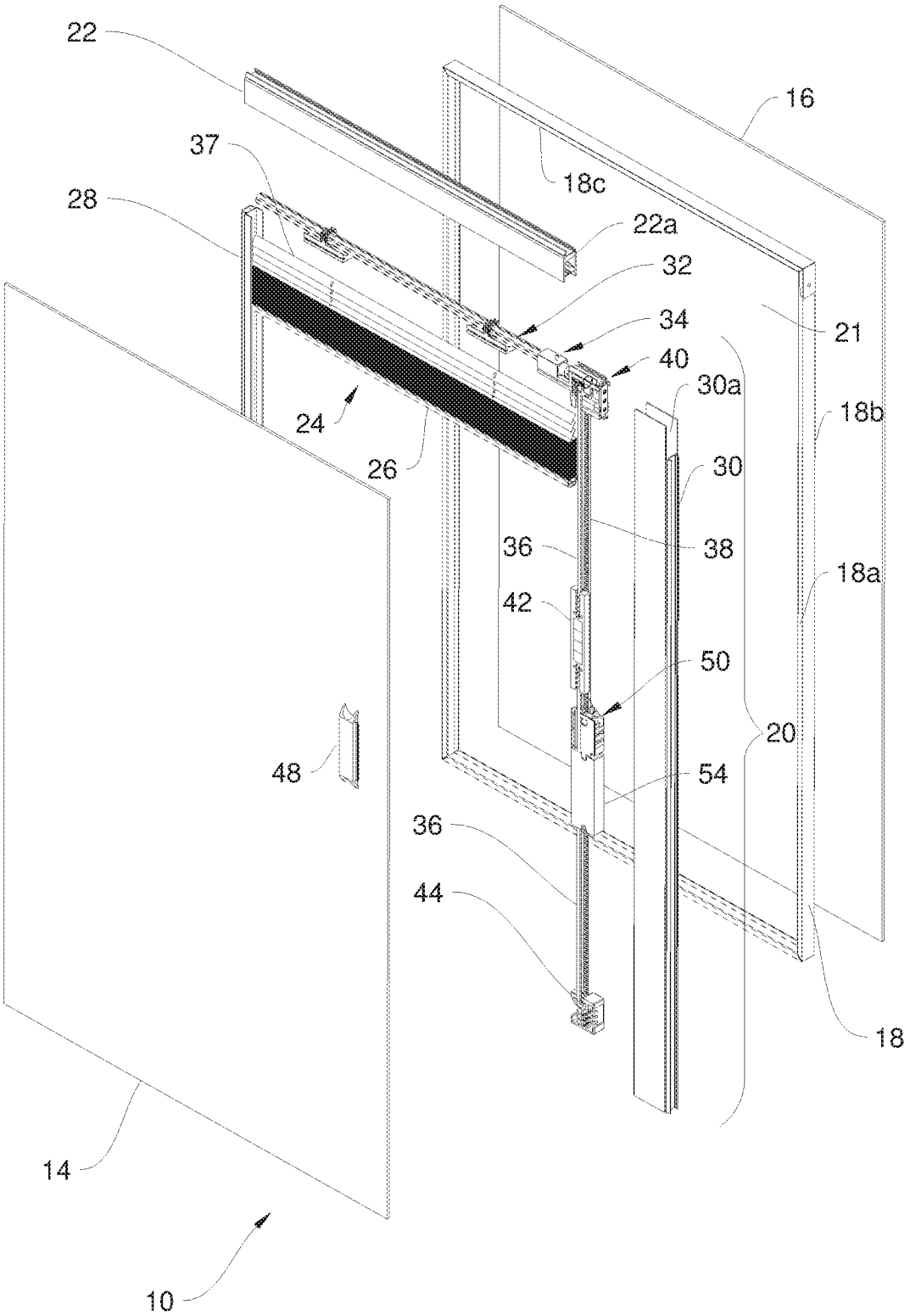
FIG. 1 is a three-dimensional, exploded corner view of the self-locking, balance weight-type insulated glass assembly having internal blinds, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader and should not in any way be interpreted as limiting.

As shown in FIGS. 1-9, the invention relates to a self-locking, balance weight-type insulated glass assembly having internal blinds 10.

Referring to FIG. 1, there is illustrated a self-locking, balance weight-type insulated glass assembly having internal blinds 10. The self-locking, balance weight-type insulated glass assembly having internal blinds 10 comprises two sheets or panes 14 and 16 of insulated glass, a rectangular spacer frame 18, and an internal blinds assembly 20. The front and rear panes 14 and 16 of glass, respectively, are arrayed front and back, respectively, and disposed against opposite sides of a rectangular shaped spacer frame 18 to form an insulated inner cavity 21. A sealant can be disposed about the joint formed between the front pane 14 of glass and an inner peripheral surface 18*a* of the spacer frame 18 and about the joint formed between the rear pane 16 of glass and an outer peripheral surface 18*b* of the spacer frame 18.

With the insulated glass panes 14 and 16 disposed against opposite sides of the rectangular spacer frame 18, the internal blinds assembly 20 is arranged in the inner cavity 21 between the insulated glass panes 14 and 16.

The internal blinds assembly 20 comprises a head rail 22 attached to the underside 18*c* of the upper side of the rectangular spacer frame 18, a slat assembly 24 hung on the head rail 22, a bottom rail 26 attached to the slat assembly by pull cords and ladder cords, a privacy fascia 28 and a side rail 30 respectively attached to the two vertical sides of the spacer frame 18.

The head rail 22 is hollow, and a rotary rod assembly 32 and a rotary rod locking device 34 are arranged in an inner cavity 22*a* of the head rail 22. The slat assembly 24, the bottom rail 26 and the rotary rod assembly 32 are connected through a pull cord (not shown) used for controlling the slats 37 to rise or fall as well as a ladder cord (not shown) used for controlling the slats to turn. One end of the rotary rod locking device 34 is connected to the rotary rod assembly 32, and the other end of the rotary rod locking device 34 is connected to a gear box 40.

Figure 2:
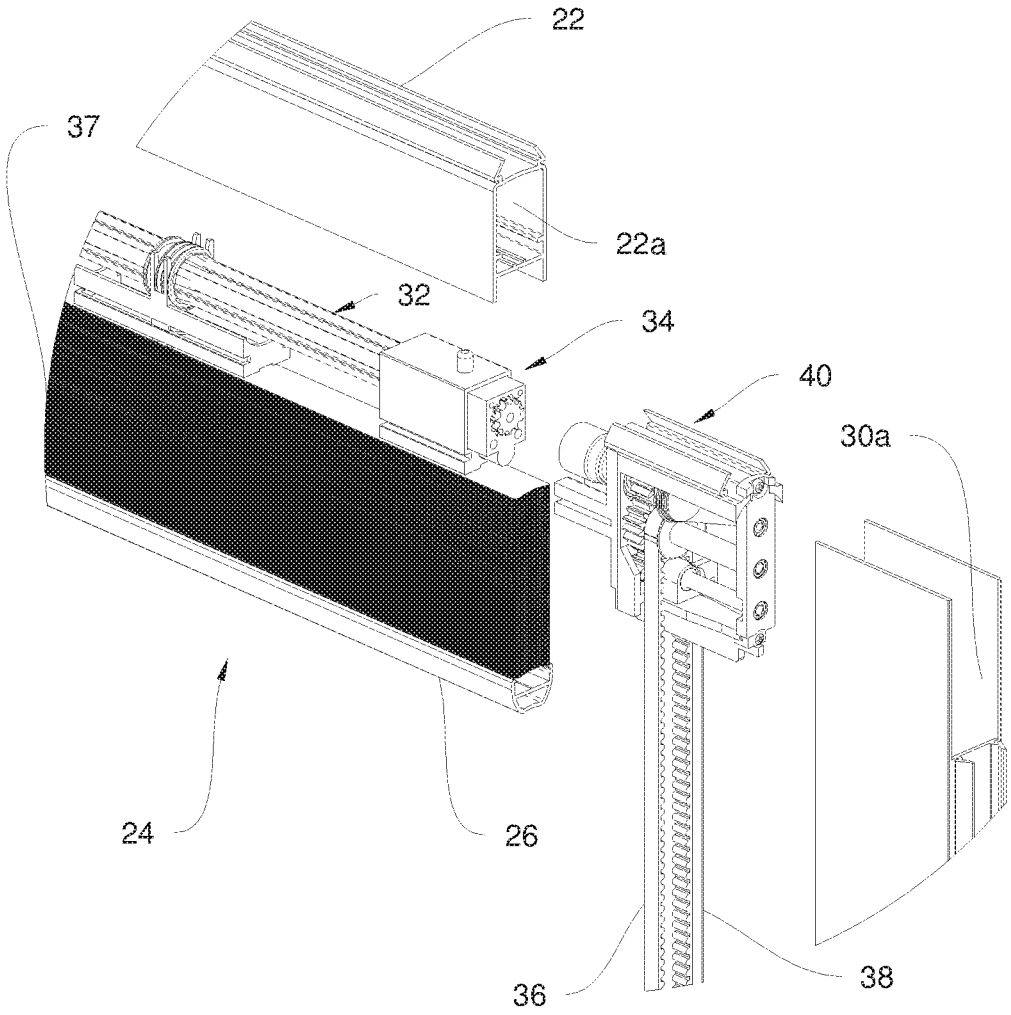
FIG. 2 is a three-dimensional, exploded corner view of a portion of the rotary rod assembly, the rotary rod locking device and the gear box, in accordance with the present invention.

The gear box 40, as shown in FIG. 2, is arranged at the top of the hollow inner cavity 30*a* of the side rail 30. An internal magnetic operator 42, a belt tensioning wheel 44 and a belt 36 are arranged below the gear box 40. An external magnetic operator 48 that is magnetically coupled to the internal magnetic operator 42 is arranged on the outer facing surface of the pane 14 of insulated glass.

The self-locking, balance weight-type insulated glass assembly having internal blinds 10 further includes a counter-weight self-locking device 50 connected to the gear box 40 through a counter-weight line 38, and a counter-weight 54 fixed below the counter-weight self-locking device 50.

Figure 6:
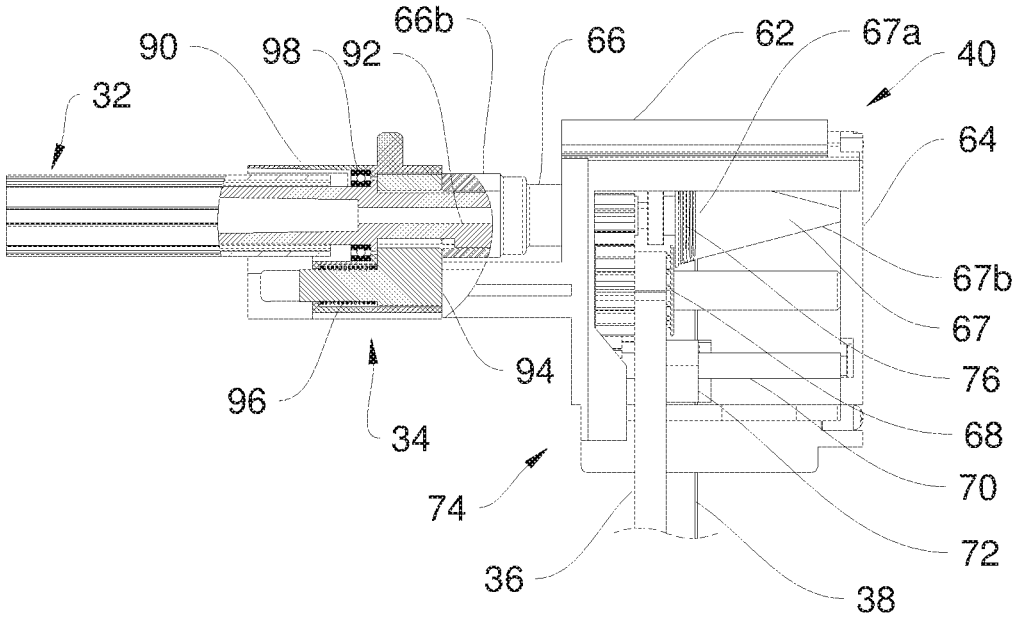
FIG. 6 is a partial sectional view of the rotary rod locking device connected to a gear box, in accordance with the present invention.
Figure 7:
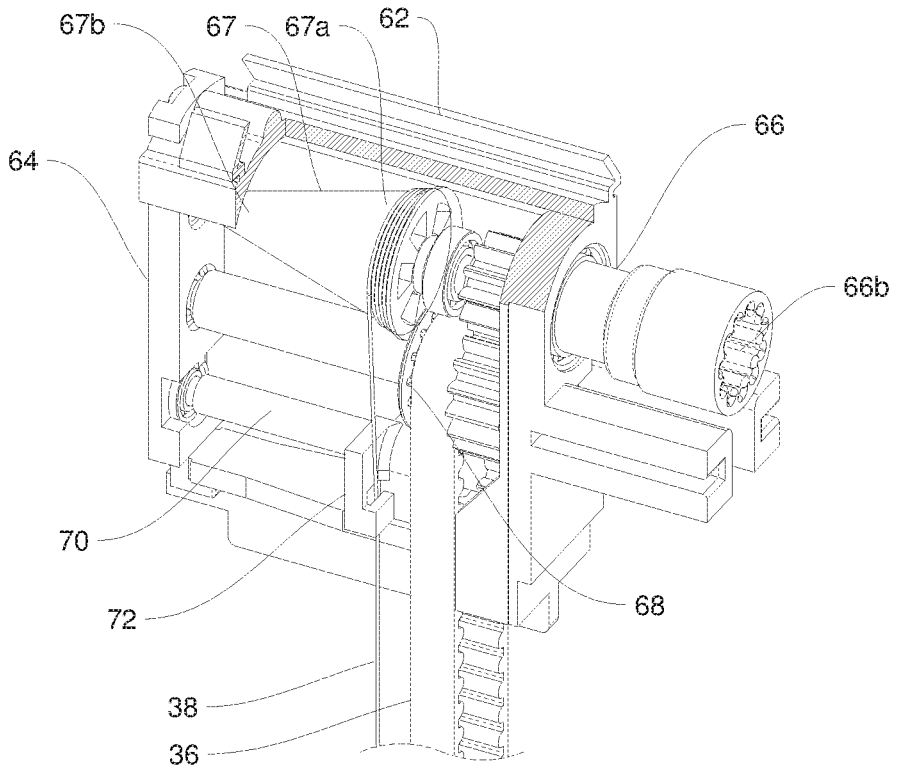
FIG. 7 is a three-dimensional, corner view of the gear box, in accordance with the present invention.

The internal blinds assembly 20 has the gear box 40 arranged at the top of the inner cavity 30*a* of the side rail 30. As shown in FIG. 6, the gear box 40 includes a gear box seat 62, a gear box cover 64, a cone wheel shaft 66, a belt wheel 68, a screw rod 70 and a counter-weight line guide 72. The gear box seat 62 and the gear box cover 64 are fixed to the upper end of the side rail 30. Two ends of the belt 36 are connected to an upper end and a lower end of the internal magnetic operator 42 to form a closed loop and are wound on the belt wheel 68 and the belt tensioning wheel 44. The cone wheel shaft 66, the belt wheel 68 and the screw rod 70 are connected in an engaged manner through a gear set 74. The cone wheel shaft 66 has an end provided with an internal gear 66*b* and an end provided with a cone wheel 67. A large-diameter end 67*a* of the cone wheel shaft 66 is connected to one end of the counter-weight line 38 while the other end of the counter-weight line 38 extends through the counter-weight line guide 72 to be connected to the counter-weight self-locking device 50.

When the slat assembly 24 in a fully folded state descends to be completely unfolded, the counter weight line 38 is horizontally pushed by the counter weight line guide 72 to be wound from the large-diameter end 67*a* of the cone wheel 67 to a small-diameter end 67*b* of the cone wheel 67. Torque applied by the gravity of the counter weight 54 to the cone wheel shaft 66 via the counter weight line 38 is decreased from the maximum value to the minimum value and is always kept in balance with a torque which is applied by the slat assembly 24 to the rotary rod assembly 32 and transmitted to the cone wheel shaft 66 via the rotary rod locking device 34, and vice versa.

As seen in FIG. 6, a threaded groove 76 is formed in a cone face of the cone wheel 67, and the counter-weight line 38 falls into the threaded groove 76 when wound on the cone wheel 67. The counter-weight line guide 72 is internally provided with an internal thread and is matched with the screw rod 70. When the screw rod 70 rotates, the counter-weight line guide 72 moves horizontally leftwards or rightwards to push the counter-weight line 38 to a corresponding position in the threaded groove 76 on the cone wheel 67.

Figure 8:
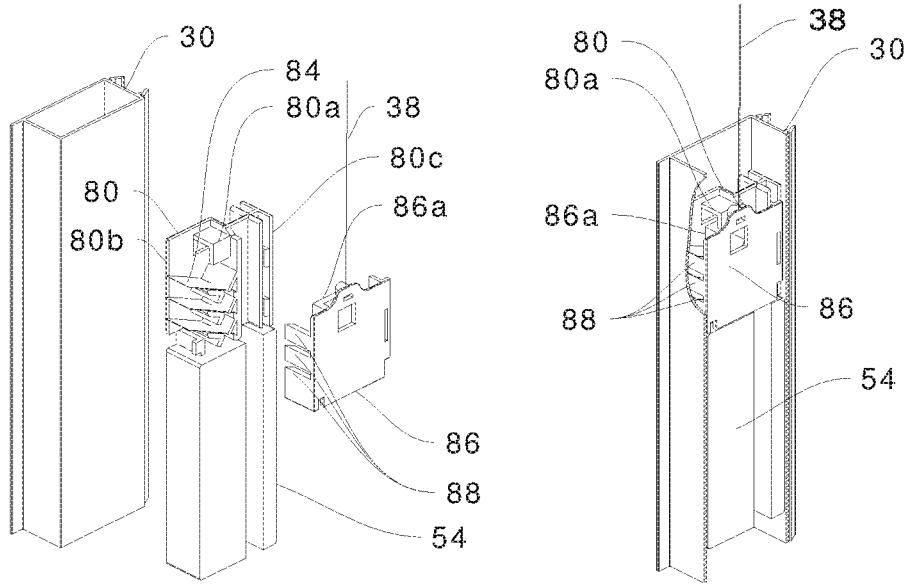
FIG. 8 is a structure diagram of a counter-weight self-locking device, in accordance with the present invention.

As shown in FIGS. 1 and 8, the counter-weight self-locking device 50 is mounted in the side rail 30. The counter-weight 54 is arranged below the counter weight self-locking device 50, and the counter weight 54 and the counter-weight self-locking device 50 are slightly thinner and narrower than the inner-diameter of the cavity of the side rail 30.

The counter-weight self-locking device 50 comprises a stationary base 80. The stationary base 80 has a bottom fixed to the counter-weight 54 and is provided with a base limit stop 80*a*. A set of elastic pieces 84, wherein each of the elastic pieces 84 has an end 84*a* fixed to the base 80, and a free end 84*b*. The free ends 84*b* of the elastic pieces 84 obliquely stretch upwards to be slightly beyond the vertical edge 80*b* of the base 80. The distance between the free ends 84*b* of the elastic pieces 84 and the other vertical edge 80*c* of the base 80 is slightly greater than an inner diameter of the side rail 30 in a corresponding direction.

Figure 9:
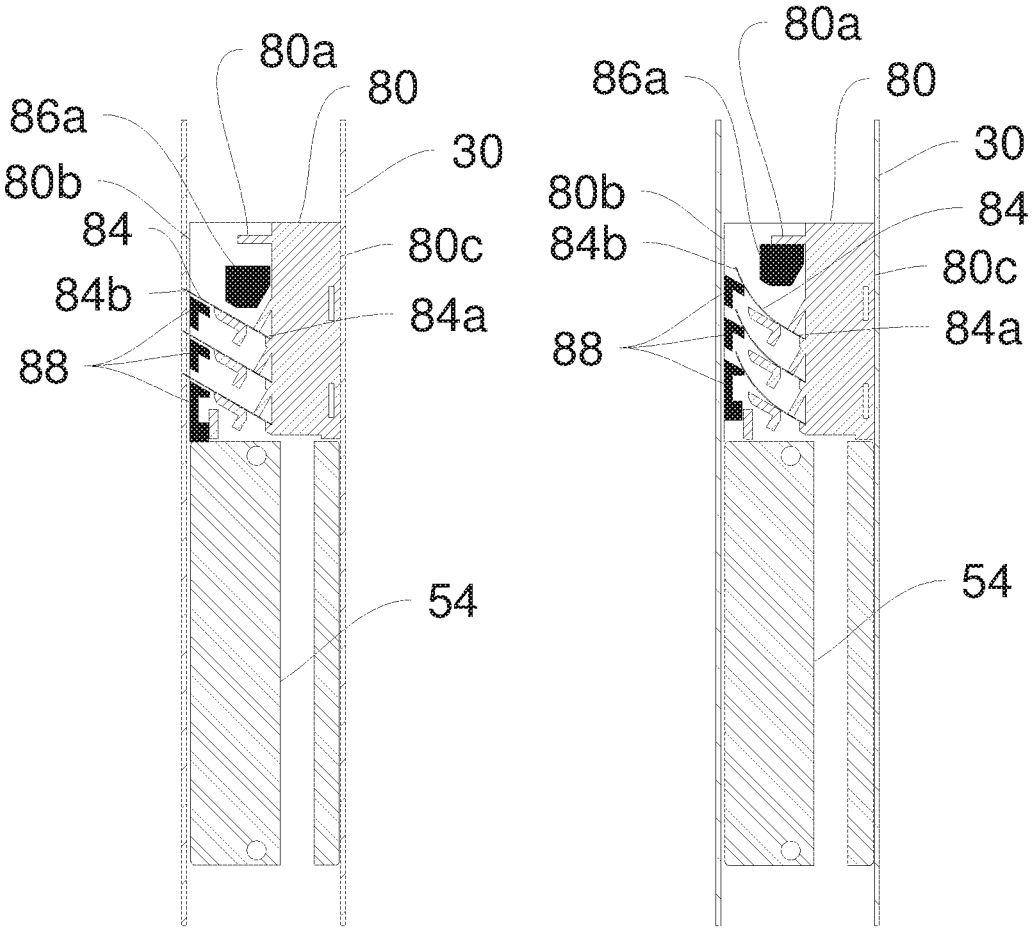
FIG. 9 is a cross-sectional view of the counter-weight self-locking device in a self-locked state and in a free state, in accordance with the present invention.

As shown in FIGS. 8 and 9, a cover plate 86 is provided with a set of elastic piece ejector blocks 88 located below the free ends 84*b* of the elastic pieces 84, and a cover plate limit stop 86*a* arranged below the base limit stop 80*a*. The cover plate 86 is connected to one end of the counter-weight line 38 and is able to move upwards or downwards between the base limit stop 80*a* and the counter-weight 54. When the self-locking balance weight-type insulated glass assembly having internal blinds 10 is vertically placed, the counter-weight 50 pulls the base 80 downwards by gravity. The cover plate 86 is pulled by the counter-weight line 38 to move upwards relative to the base 80 until the cover plate limit stop 86*a* touches the base limit stop 80*a*. At this moment, the elastic piece ejector blocks 88 located below the free ends 84*b* of the elastic pieces 84 eject the free ends 84*b* of the elastic pieces 84 to force the elastic pieces 84 to bend. Then the free ends 84*b* of the elastic pieces 84 retreat into the vertical edge 80*b* of the base 80, so that the elastic pieces 84 fail to touch the side rail 30, and the counter-weight, self-locking device 50 and the counter weight 54 are pulled by the counter weight line 38 to move upwards or downwards freely. When the self-locking balance weight-type insulated glass assembly having internal blinds 10 is horizontally placed, the counter-weight 54 is supported by the side rail 30 and cannot pull the base 80 to move. In this case, the elastic pieces 84 stretch out of the vertical edge 80*b* of the base 80 to be in close contact with the inner wall of the side rail 30 and are self-locked in a direction from the counter-weight 54 to the counter-weight self-locking device 50. At this time, the counter-weight 54 cannot move in this direction or in the other direction either under the traction from the counter weight line 38.

According to the self-locking balance weight-type insulated glass assembly having internal blinds 10, long grooves which are slightly wider than the belt 36 are formed in the counter-weight 54 and the counter-weight self-locking device 50. The belt 36 penetrates through the long grooves to be connected to the belt wheel 68 in the gear box 40, the belt tensioning wheel 44 and the internal magnetic operator 42.

As shown in FIGS. 3 to 6, the rotary rod locking device 34 comprises a stationary base 90, a gear shaft 92, a locking ring 94 and a spring 96. The stationary base 90 is fixed in the head rail 22 and is located at one end of the rotary rod assembly 32. The middle of the gear shaft 92 is fixed to the stationary base 90 through a bearing 98. One of two ends of the gear shaft 92 is fixed to the rotary rod assembly 32, and the other end of the gear shaft 92 is provided with an external gear 93 which extends out of the stationary base 90.

A cavity 90*a* is formed in the stationary base 90, and the locking ring 94 is in clearance fit with the cavity and is internally provided with an internal gear 94*a* matched with the external gear 93 at one end of the gear shaft 92. The spring 96 is arranged between the locking ring 94 and the stationary base 90. When the locking ring 94 is pushed into the stationary base90 by the internal gear 66*b* located on the cone wheel shaft 66 in the gear box 40, the internal gear 66*b* on the cone wheel shaft 66 is engaged with the external gear 93 on the gear shaft 92. Then the rotary rod assembly 32 is controlled by the gear box 40. When the external gear 93 is to be separated from the internal gear 66*b* on the cone wheel shaft 62, the locking ring 94 is partially pushed out by the spring 96 to be partially matched with a cavity 90*a* of the stationary base90. The internal gear 94*a* of the locking ring 94 is partially engaged with the external gear 93 on the gear shaft 92, and then the gear shaft 92 and the rotary rod assembly 32 are locked by the locking ring 94 to be prevented from rotating.

As shown in FIG. 8 and FIG. 9, when the self-locking balance weight-type insulated glass assembly having internal blinds 10 is vertically placed, the counter-weight 54 pulls the base 80 downwards by gravity until the base limit stop 80*a* touches the cover plate limit stop 72*a*. At this moment, the elastic piece ejector blocks 88 located below the free ends 84*b* of the elastic pieces 84 eject the free ends 84*b* of the elastic pieces 84 to force the elastic pieces 84 to bend, and then the free ends 84*b* of the elastic pieces 84 retreat into the vertical edges 80*b* of the base 80, so that the elastic pieces 84 fail to touch the side rail 30.

The counter-weight 54 and the counter-weight self-locking device 50 are pulled by the counter-weight line 38 to freely move upwards or downwards in the side rail 30, and the gravity of the counter-weight 54 is transmitted by the counter-weight self-locking device 50 to the counter-weight line 38 to enable the counter weight line 38 to generate a pulling force.

As shown in FIG. 1 and FIG. 6, when the external magnetic operator 48 is moved downwards, the internal magnetic operator 42 magnetically coupled to the external magnetic operator 48 drives the belt 36, connected to the internal magnetic operator 42, to move downwards accordingly, so as to drive the belt wheel 68, the screw rod 70, the cone wheel shaft 66, the gear shaft 92 engaged with the cone wheel shaft 66, and the rotary rod assembly 34 fixed to the gear shaft 92 to rotate synchronously, the slat assembly 24 is pulled to rise continuously, and the torque applied by the slat assembly 24 to the rotary rod assembly 34 is gradually increased. At the same time, the screw rod 70 rotates to push the counter-weight line guide 72 and the counter-weight line 38 to move towards the large-diameter end 67*a* of the cone wheel 67. The counter weight line 38 is gradually unwound from the cone wheel 67, the arm of the pulling force of the counter weight line 38 becomes larger and larger, and a reverse torque applied by the pulling force to the cone wheel 67 becomes larger and larger accordingly and is transmitted by the gear shaft 92 of the rotary rod locking device 34 to the rotary rod assembly 34 and is always kept in balance with the torque applied by the slat assembly 24 to the rotary rod assembly 34. In this way, the slat assembly 24 can be easily controlled to rise or fall and to turn with a small force, and this is also available to large-sized insulated glass assembly having internal blinds.

As shown in FIG. 8 and FIG. 9, in most cases, the self-locking balance weight-type insulated glass assembly having internal blinds 10 is horizontally placed when transported. In these cases, the side rail 30 is horizontal and the counter-weight 54 fails to apply a pulling force to the base 80 of the counter-weight self-locking device 50 by gravity. The elastic pieces 84 in the base 80 are not ejected by the elastic piece ejector blocks 88 on the cover plate 86. The elastic pieces 84 are kept straight with the free ends 84*b* stretching out of the vertical edges 80*b* of the base 80 to be in close contact with the inner surface of the side rail 30 so as to realize self-locking, and the counter weight 54 cannot move towards the counter weight self-locking device 50 and under effect of the pulling force from the counter weight line 38, the counter weight 54 cannot move in the opposite direction either, and thus, impact damage to other parts caused by movement of the counter weight 54 is avoided. Similarly, the side rail 30, and the gear box 40, the internal magnetic separator 42, the counter weight self-locking device 50, the counter weight 54, the belt tensioning wheel 44 and the belt inside the side rail 30 can be independently stored or transported after being assembled, and thus, damage to the product caused by movement of the counter weight 54 is avoided.

Figure 3:
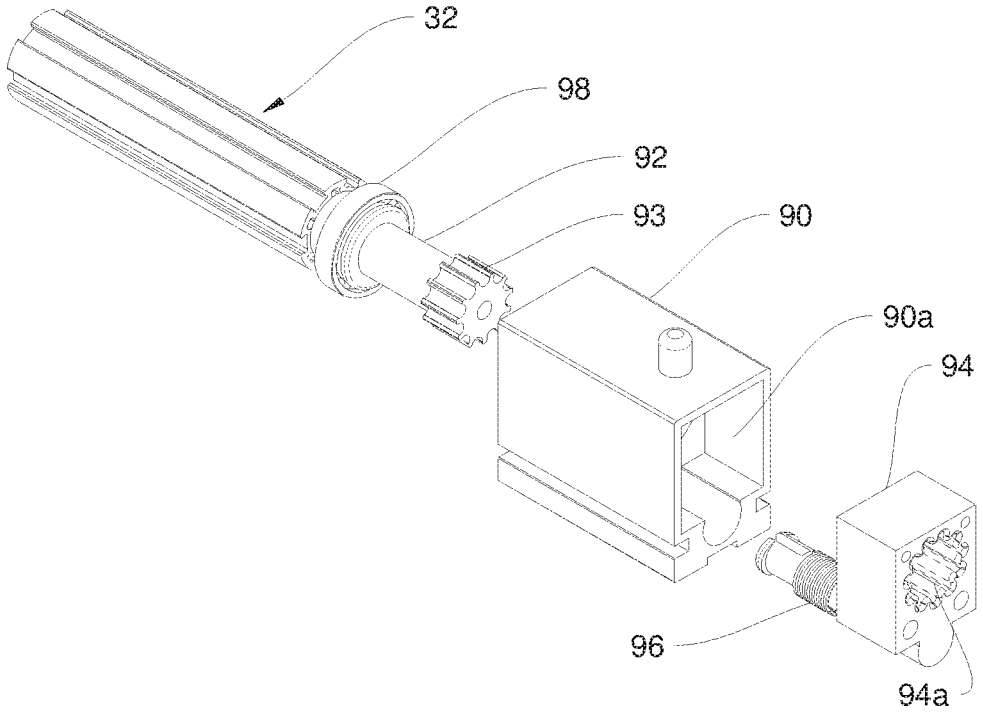
FIG. 3 is a three-dimensional, exploded corner view of the rotary rod assembly and rotary rod locking device, in accordance with the present invention.
Figure 4:
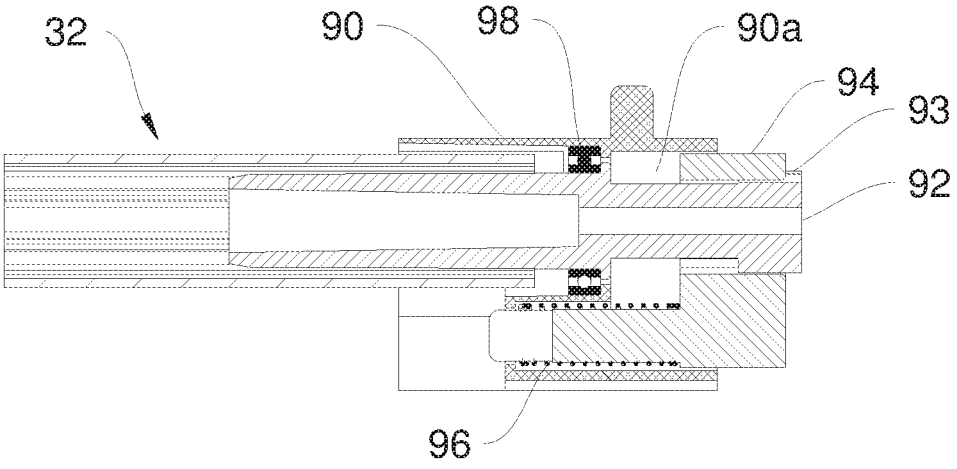
FIG. 4 is a sectional view of the rotary rod locking device in a locked state, in accordance with the present invention.
Figure 5:
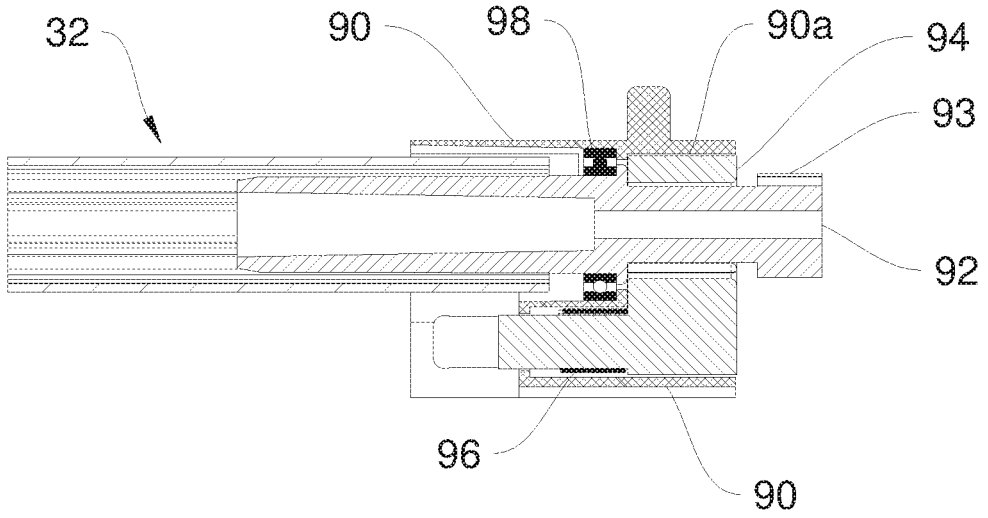
FIG. 5 is a sectional view of the rotary rod locking device in a free state, in accordance with the present invention.

As shown in FIG. 2, FIG. 3 and FIG. 4, in the case where the head rail 22 is not yet assembled on the side rail 30, the stationary base 90 is fixed into the head rail 22, the gear box 40 in the side rail 30 is not connected to the rotary rod locking device 34. The locking ring 94 cannot rotate after being pushed by the spring 96 out of the stationary base 90 by a certain distance due to the fact that part of the locking ring 94 is matched with the cavity 90*a* of the stationary base 90 and the internal gear 94*a* of the locking ring 94 is partially engaged with the external gear 93 on the gear shaft 92, so that the gear shaft 92 is locked and cannot rotate freely, and the rotary rod assembly 32 fixed to the gear shaft 92 cannot freely rotate either. In this way, the folded slat assembly 24 will not be unfolded; and the bottom rail, the slat assembly and the head rail can be stored and transported independently of the side rail after being assembled, so that the space is saved, and slats are protected.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A self-locking balance weight insulated glass assembly having internal blinds, comprising two panes of glass, and a blinds assembly, wherein the two panes of glass are arrayed front and back, and an inner cavity is located between the two panes of glass and is formed by a spacer, and the blinds assembly is arranged in the inner cavity of the insulated glass assembly, the blinds assembly comprising a head rail attached to a top of the spacer, a slat assembly hung on the head rail, a bottom rail, and a privacy fascia and a hollow side rail which are attached to respective sides of the spacer, characterized in that:

the head rail has a hollow inner cavity, and a rotary rod assembly and a rotary rod locking device are arranged in the inner cavity of the head rail;

the slat assembly, the bottom rail and the rotary rod assembly are connected through a pull cord used for controlling slats of the slat assembly to rise or fall;

the rotary rod locking device has an end connected to the rotary rod assembly and an end connected to a gear box;

the side rail has an inner cavity and the gear box is arranged at a top of the inner cavity of the side rail;

an internal magnetic operator, a belt tensioning wheel and a belt are arranged under the gear box;

an external magnetic operator magnetically coupled to the internal magnetic operator, the external magnetic operator being arranged outside the inner cavity formed by the panes of glass; and the self-locking balance weight insulated glass assembly having internal blinds further comprises a counter-weight self-locking device connected to the gear box through a counter-weight line, and a counter-weight fixed below the counter-weight self-locking device.

2. The self-locking balance weight insulated glass assembly having internal blinds according to claim 1, wherein:

the gear box comprises a cone wheel shaft, a belt wheel, a screw rod and a counter-weight line guide;

first and second ends of the belt are connected to a respective end of the internal magnetic operator to form a closed loop and are wound on the belt wheel and the belt tensioning wheel; and the cone wheel shaft, the belt wheel and the screw rod are connected in an engaged manner through a gear set.

3. The self-locking balance weight insulated glass assembly having internal blinds according to claim 2, wherein:

the cone wheel shaft has an end provided with an internal gear and an end provided with a cone wheel;

a large-diameter end of the cone wheel is connected to one end of the counter-weight line; and the counter-weight line has an end penetrating through the counter-weight line guide to be connected to the counter-weight self-locking device.

4. The self-locking balance weight insulated glass assembly having internal blinds according to claim 3, wherein:

when the slat assembly in a fully folded state descends to be completely unfolded, the counter-weight line is horizontally pushed by the counter-weight line guide to be wound from the large-diameter end of the cone wheel to a small-diameter end of the cone wheel; and a torque applied by the counter-weight to the cone wheel shaft via the counter weight line is decreased from the maximum to the minimum and is always kept in balance with a torque which is applied by the slat assembly to the rotary rod assembly and transmitted to the cone wheel shaft via the rotary rod locking device, and vice versa.

5. The self-locking balance weight insulated glass assembly having internal blinds according to claim 4, wherein a threaded groove is formed in a cone face of the cone wheel, and the counter-weight line falls into the threaded groove when wound on the cone wheel; and the counter-weight line guide is internally provided with an internal thread and is matched with the screw rod whereby when the screw rod rotates, the counter-weight line guide horizontally moves leftwards or rightwards to push the counter-weight line to a corresponding position of the cone wheel.

6. The self-locking balance weight insulated glass assembly having internal blinds according to claim 1, wherein the counter-weight self-locking device is mounted in the side rail, the counter-weight is arranged below the counter-weight self-locking device, and the counter-weight self-locking device and the counter-weight are thinner and narrower than the inner cavity of the side rail.

7. The self-locking balance weight insulated glass assembly having internal blinds according to claim 6, wherein the counter-weight self-locking device comprises:

a base having a bottom fixed to the counter-weight and provided with a base limit stop;

a set of elastic pieces each having a first end fixed to the base, and a free second end;

each of the elastic pieces having the first end disposed at an angle relative to one vertical edge of the base, and the free second end of the elastic pieces obliquely stretch upwards to be slightly beyond the vertical edge of the base;

the distance between the free ends of the elastic pieces and another vertical edge of the base is slightly greater than the inner cavity of the side rail in a corresponding direction; and a cover plate having a set of elastic piece ejector blocks located below the free ends of the elastic pieces and provided with a cover plate limit stop located below the base limit stop; and the cover plate being connected to an end of the counter-weight line and able to move upwards or downwards between the base limit stop and the counter-weight.

8. The self-locking balance weight insulated glass assembly having internal blinds according to claim 7, wherein:

when the self-locking balance weight insulated glass assembly having internal blinds is vertically placed, the counter-weight pulls the base downwards by gravity, the cover plate is pulled by the counter-weight line to move upwards relative to the base until the cover plate limit stop touches the base limit stop, when the elastic piece ejector blocks located below the free ends of the elastic pieces eject the free ends of the elastic pieces to force the elastic pieces to bend, and then the free ends of the elastic pieces retreat into the vertical edges of the base, so that the elastic pieces fail to touch the side rail, and the counter-weight self-locking device and the counter-weight are pulled by the counter weight line to move upwards or downwards freely; and when the self-locking balance weight insulated glass assembly having internal blinds is horizontally placed, the counter weight is supported by the side rail and cannot pull the base to move, the free ends of the elastic pieces stretch out of the vertical edges of the base to be in close contact with an inner wall of the side rail and are self-locked in a first direction from the counter weight to the counter-weight self-locking device, and the counter-weight cannot move in this first direction or in an opposite second direction under the traction from the counter-weight line.

9. The self-locking balance weight type insulated glass assembly having internal blinds according to claim 4, further including:

long grooves which are wider than the belt are formed in the counter-weight and the counter weight self-locking device; and the belt penetrates through the long grooves to be connected to the belt wheel in the gear box, the belt tensioning wheel, and the internal magnetic operator.

10. The self-locking balance weight insulated glass assembly having internal blinds according to claim 1, wherein:

the rotary rod locking device comprises a stationary base, a gear shaft, a locking ring and a spring;

the stationary base is fixed in the head rail and is located at one end of the rotary rod assembly; and a middle of the gear shaft is fixed to the stationary base through a bearing;

a first end of the gear shaft is fixed to the rotary rod assembly, and the other second end of the gear shaft has an external gear which extends over the stationary base.

11. The self-locking balance weight insulated glass assembly having internal blinds according to claim 10, wherein:

a cavity is formed in the stationary base, and the locking ring is in clearance fit with the cavity and is internally provided with an internal gear matched with the external gear at the second end of the gear shaft; and the spring is arranged between the locking ring and the stationary base.

12. The self-locking balance weight insulated glass assembly having internal blinds according to claim 11, wherein:

when the locking ring is pushed into the stationary base by the internal gear located on the cone wheel shaft of the gear box, the internal gear on the cone wheel shaft is engaged with the external gear on the gear shaft, and the rotary rod assembly is controlled by the gear box.

13. The self-locking balance weight insulated glass assembly having internal blinds according to claim 12, wherein:

when separated from the internal gear located on the cone wheel shaft, the locking ring is partially pushed out by the spring to be partially matched with the cavity of the stationary base, the internal gear of the locking ring is partially engaged with the external gear on the gear shaft, and the gear shaft and the rotary rod assembly are locked by the locking ring to be prevented from rotating.

14. A method of operating a self-locking balance weight insulated glass assembly having internal blinds, comprising two panes of glass, and a blinds assembly, wherein the two panes of glass are arrayed front and back, and an inner cavity is located between the two panes of glass and is formed by a spacer, and the blinds assembly is arranged in the inner cavity of the insulated glass assembly, the blinds assembly comprising a head rail attached to a top of the spacer, a slat assembly having a plurality of slats hung on the head rail, a bottom rail, and a privacy fascia and a hollow side rail which are attached to respective sides of the spacer, comprising the steps of:

arranging a rotary rod assembly and a rotary rod locking device in an inner cavity of the head rail;

connecting the slat assembly, the bottom rail and the rotary rod;

connecting a fist end of the rotary rod locking device to the rotary rod assembly and a second end of the rotary rod locking device to a gear box;

arranging the gear box at a top of an inner cavity of the side rail;

arranging an internal magnetic operator, a belt tensioning wheel and a belt under the gear box; and magnetically coupling an external magnetic operator to the internal magnetic operator, the external magnetic operator being arranged outside the inner cavity formed by the panes of glass, and further including connecting a counter-weight self-locking device to the gear box through a counter-weight line, and a counter-weight fixed below the counter weight self-locking device.

15. The method of operating a self-locking balance weight insulated glass assembly having internal blinds of claim 14 further including:

providing the gear box with a cone wheel shaft, a belt wheel, a screw rod and a counter-weight line guide;

connecting first and second ends of the belt to an upper end and to a lower end of the internal magnetic operator to form a closed belt loop;

winding the closed belt loop on the belt wheel and the belt tensioning wheel; and connecting the cone wheel shaft, the belt wheel and the screw rod in an engaged manner through a gear set.

16. The method of operating a self-locking balance weight insulated glass assembly having internal blinds of claim 15 further including:

providing a cone wheel on an end of the cone wheel shaft having an internal gear;

connecting a large-diameter end of the cone wheel to one end of the counter-weight line;

penetrating an end of the counter-weight line through the counter-weight line guide; and connecting the end of the counter-weight line to the counter-weight self-locking device.

17. The method of operating a self-locking balance weight insulated glass assembly having internal blinds of claim 16 further including:

when the slat assembly in a fully folded state descends to be completely unfolded, the counter-weight line is horizontally pushed by the counter-weight line guide to be wound from the large-diameter end of the cone wheel to a small-diameter end of the cone wheel;

decreasing a torque applied by the counter-weight to the cone wheel shaft via the counter weight line from the maximum to the minimum whereby the cone wheel shaft is always kept in balance with a torque which is applied by the slat assembly to the rotary rod assembly and transmitted to the cone wheel shaft via the rotary rod locking device, and vice versa.

18. The method of operating a self-locking balance weight insulated glass assembly having internal blinds of claim 17 further including:

providing a rotary rod locking device comprising a stationary base, a gear shaft, a locking ring and a spring;

fixing the stationary base in the head rail and located the stationary base at one end of the rotary rod assembly;

fixing a middle of the gear shaft to the stationary base through a bearing; and fixing a first end of the gear shaft to the rotary rod assembly, and providing the other second end of the gear shaft with an external gear which extends over the stationary base;

forming a cavity in the stationary base, and disposing the locking ring with a clearance fit within the cavity and internally providing an internal gear matched with the external gear at the second end of the gear shaft;

arranging the spring between the locking ring and the stationary base;

when locking ring is pushed into the stationary base by the internal gear located on the cone wheel shaft of the gear box, engaging the internal gear on the cone wheel shaft with the external gear on the gear shaft, and controlling the rotary rod assembly by the gear box; and when separated from the internal gear located on the cone wheel shaft, the locking ring is partially pushed out by the spring to be partially matched with the cavity of the stationary base, the internal gear of the locking ring is partially engaged with the external gear on the gear shaft, and the gear shaft and the rotary rod assembly are locked by the locking ring to be prevented from rotating.

* * * * *